US005941773A

United States Patent [19]

Harlick

[11] Patent Number: 5,941,773

[45] Date of Patent: Aug. 24, 1999

[54] MYSTERY JACKPOT CONTROLLER

[75] Inventor: Neville Harlick, Kogarah, Australia

[73] Assignee: Aristocrat Leisure Industries PTY Ltd., Australia

[21] Appl. No.: 08/730,988

[22] Filed: Oct. 16, 1996

[30] Foreign Application Priority Data

Oct. 19, 1995 [AU] Australia ..... PN6062

[51] Int. Cl.[6] ..... A63F 9/22

[52] U.S. Cl. ..... 463/26; 463/16

[58] Field of Search ..... 463/16, 17, 20, 463/21, 25, 26, 27, 28, 40, 42

[56] References Cited

U.S. PATENT DOCUMENTS

| | | | |
|---|---|---|---|
| 4,624,459 | 11/1986 | Kaufman | 463/27 |
| 4,652,998 | 3/1987 | Koza et al. | 463/26 |
| 4,815,741 | 3/1989 | Small | 463/25 |
| 5,042,809 | 8/1991 | Richardson | 463/25 |
| 5,116,055 | 5/1992 | Tracy | 463/27 |
| 5,280,909 | 1/1994 | Tracy | 463/27 |
| 5,327,485 | 7/1994 | Leaden | 463/25 |
| 5,333,868 | 8/1994 | Goldfarb | 463/25 |
| 5,415,416 | 5/1995 | Scagnelli et al. | 463/25 |
| 5,702,303 | 12/1997 | Takemoto et al. | 463/27 |

*Primary Examiner*—Jessica J. Harrison
*Attorney, Agent, or Firm*—Brown & Wood, LLP

[57] ABSTRACT

A plurality of electronic gaming machines 10 are connected to a network 11, to which a mystery jackpot controller 12 and display means 13 are also connected. Each of the electronic gaming machines 10 are provided with a network interface arranged to provide a signal onto the network 11 on each occurrence of an operation of a respective machine and the jackpot controller 12 is arranged to receive each of the machine operation signals and to generate and award a random jackpot prize on the occurrence of one of these operation signals.

14 Claims, 3 Drawing Sheets

MYSTERY JACKPOT CONTROLLER

INTRODUCTION

The present invention relates to apparatus for use with a system of linked poker machines and in particular the apparatus provides an improved mystery jackpot mechanism for use with such a poker machine system.

BACKGROUND OF THE INVENTION

Many schemes have been devised in the past to induce players to play slot machines including schemes such as specifying periods during which jackpot prizes are increased or bonus jackpots paid. Other schemes involve awarding an additional prize to a first player to achieve a predetermined combination on a poker machine after a given point in time. These methods, while effective, add to club overheads because of the need for additional staff to ensure that the scheme is operated smoothly. More recently, with the advent of poker machines linked through electrical networks it has been possible to automatically generate jackpot prizes on the basis of information received from the machines being played which are connected to the system and one such prior art arrangement, commonly known as "Cashcade", counts turnover (or games played) on all machines in the network, increments a prize value in accordance with the turnover (or number of games played) and pays a mystery jackpot prize when the count reaches some predetermined and randomly selected number. This arrangement has been in use in the State of New South Wales and in other jurisdictions for a considerable period of time, however, as with other aspects of slot machine games, players become bored with such arrangements and new and more innovative schemes become necessary in order to stimulate player interest.

SUMMARY OF THE INVENTION

According to a first aspect, the present invention provides a random prize awarding system associated with one or more gaming consoles each of which includes signal output means arranged to produce an output signal in response to operation of the respective console, the system including means to generate and store a pool of numbers, random selection means arranged to select a prize winning number from the pool of numbers, means responsive to the signals received from each associated console to randomly select from the pool a number corresponding to each said received signal, the signal responsive means being arranged to remove the selected number from the pool and to compare that number with the randomly selected prize winning number, recording means being arranged to record the identity of a console associated with the selected number when it equates to the randomly selected prize winning number and indicator means arranged to indicate details of the console associated with the prize winning number as a prize winning console and the prize awarded.

According to a second aspect, the present invention provides a random prize awarding system associated with one or more gaming consoles each of which includes signal output means arranged to produce an output signal in response to operation of the respective console, the system including random interval generating means to generate time intervals of random length, means responsive to the signals generated by the associated gaming consoles to count the occurrence of m games following the completion of each random time interval and to allocate a prize to the console reporting the mth game, prize generating means arranged to randomly select a prize and indication means arranged to indicate the identity of the prize winning console and the prize awarded.

In an alternative arrangement random number generating means are provided to generate a random value for m at the completion of each random time interval. Preferably m will be a relatively small number such that the period taken for m games to be played is significantly less than the respective random time interval.

Preferably the prizes awarded by the system of the present invention are monetary amounts the values of which are either a plurality of preselected values held in a pool of prize values or prize values within a range of allowable values which are either incremented or randomly selected during operation of the prize awarding system.

Where used above, the term 'console' is used to indicate a gaming machine, a gaming terminal or other device arranged to be connected to a communications system and to provide a user gaming interface. In the following description, examples are give which employ traditional slot machines, however the invention should be taken to include gaming systems which include user interfaces other than traditional slot machines.

BRIEF DESCRIPTION OF THE DRAWINGS

Embodiments of the invention will now be described by way of example, with reference to the accompanying drawings, in which.

DETAILED DESCRIPTION OF THE PREFERRED EMBODIMENTS

Figure 1:
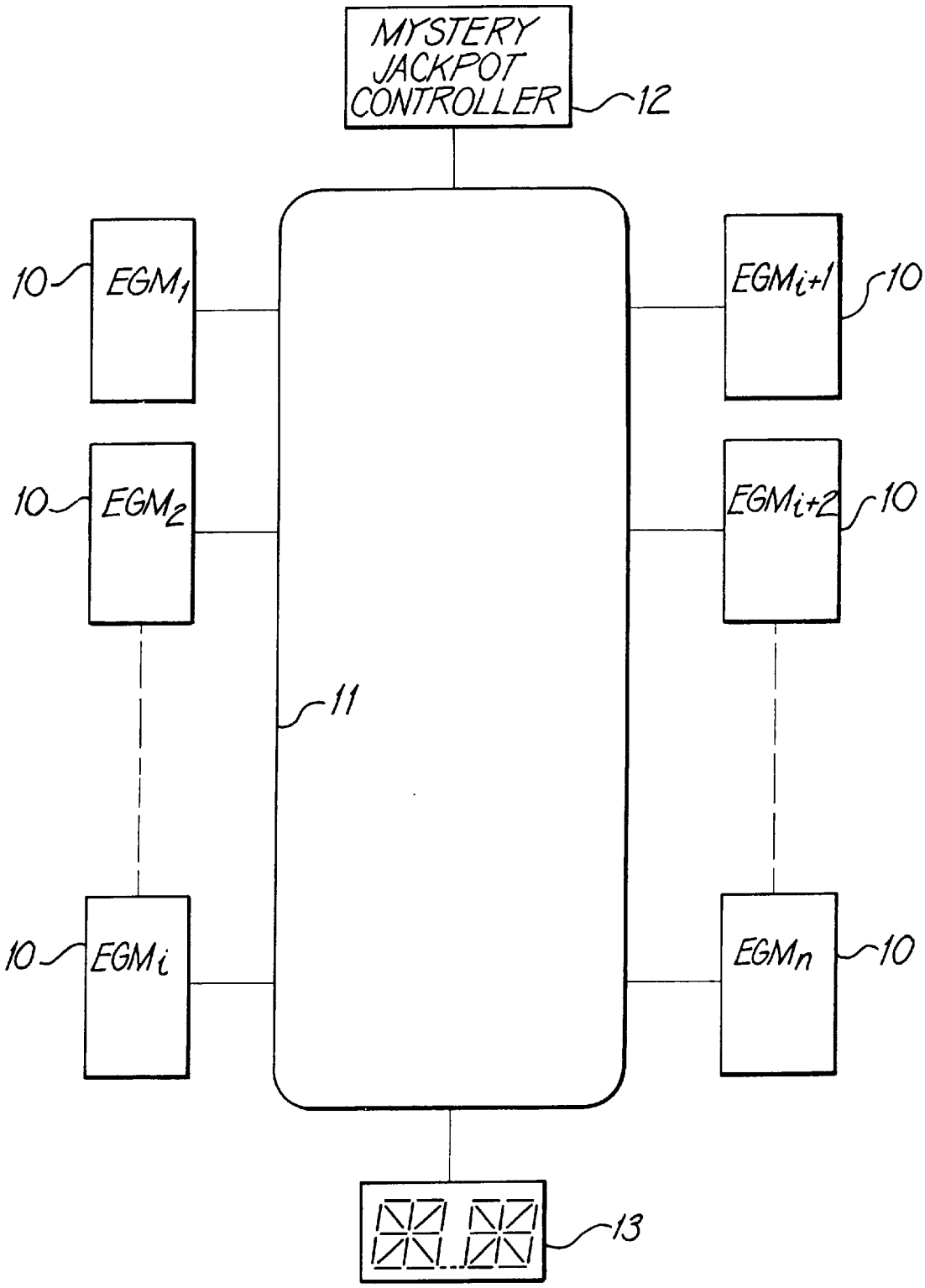
FIG. 1 is a block diagram of a network of electronic gaming machines to which a mystery jackpot controller according to the present invention is connected.

Referring to FIG. 1 a plurality of electronic gaming machines 10 are connected to a network 11, to which a mystery jackpot controller 12 and display means 13 are also connected.

Each of the electronic gaming machines 10 are provided with a network interface arranged to provide a signal onto the network 11 on each occurrence of an operation of a respective machine and the jackpot controller 12 is arranged to receive each of the machine operation signals and to generate and award a random jackpot prize on the occurrence of one of these operation signals.

Figure 2:
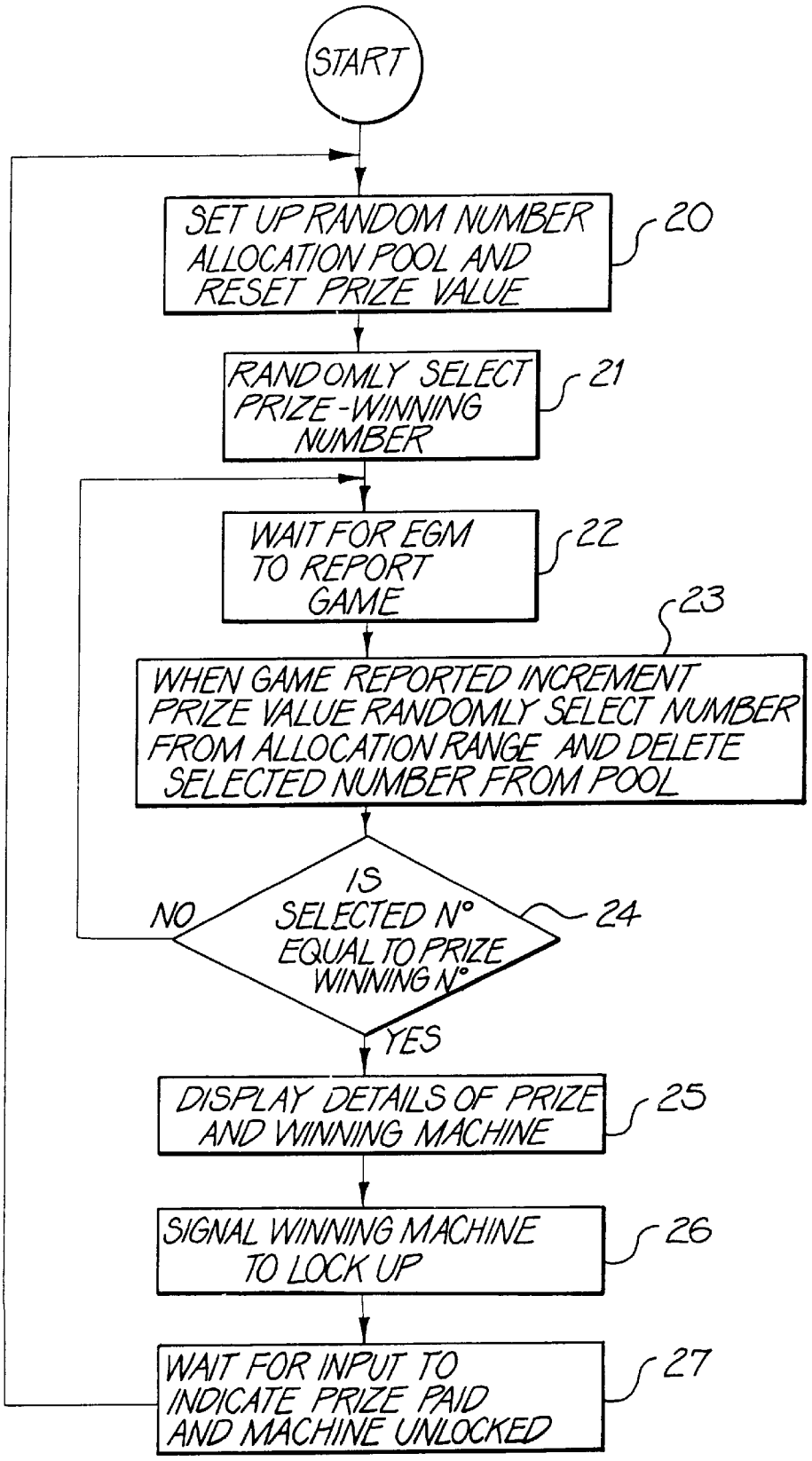
FIG. 2 is a flow chart showing a first game arrangement according to the invention.
Figure 3:
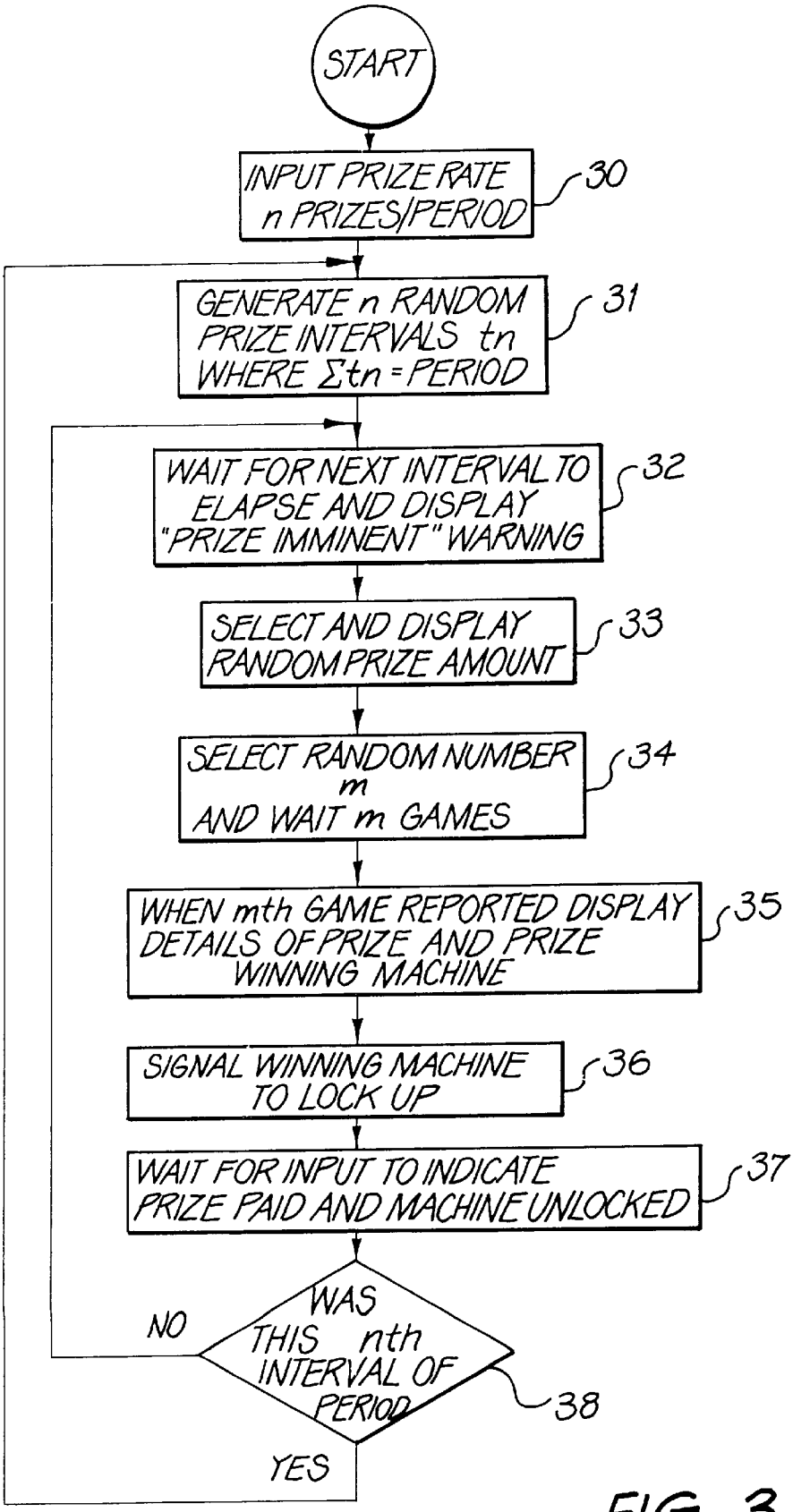
FIG. 3 is a flow chart of the game arrangement according to a further embodiment of the present invention.

Flow charts for two prize awarding algorithms are illustrated in FIGS. 2 and 3.

Referring to the algorithm of FIG. 2 machine contributions go into the prize pool as with known prior art jackpot systems, while the overhead display shows the incrementing prize value.

In step 20 the controller sets up a random number allocation pool in some user defined range e.g. 1 to 10,000 and then in step 21, randomly chooses a number to be a prize winning number. Every game that is played is reported (step 22) to the controller which not only allocates a contribution to the prize pool but randomly allocates a number from the above pool to that game and deletes that number from the pool (step 23). The number allocated to the machine is then tested (step 24) and if this number matches the controller's number a win is awarded (step 25). If a jackpot is awarded the winning machine is locked up (step 26) and the controller awaits an indication that the prize has been paid and the machine unlocked (step 27) before returning to step 20. If the number does not match then there is no jackpot win for that game and the controller returns to step 22 and waits for the next machine to report operation. This means that the jackpot win probability steadily increases towards a final value of 1 thus ensuring that the jackpot must be struck within a certain number of games.

The following is a simple numerical example to further illustrate the process. The controller randomly chooses a number in the range 1 to 10. For example, 5 say. The number pool for games is therefore also 1 to 10.

The first game played is reported to the controller which allocates a contribution to the prize pool and randomly allocates a number (from 1 to 10) to that game. Let's say it allocates 6. It checks to see if this matches its first number (5). There is no match in this case, so there is no win. The number 6 is now removed from the allocation pool.

The next game played is reported to the controller. It follows the same process as above but now can only choose a number from the 9 left in the allocation pool i.e. the probability of striking the jackpot has gone from 1/10 to 1/9.

Obviously chance says the jackpot can be won at any time and the longer it runs the greater will be the "prize".

If the "starting value" were set at $25 and the contribution per game is $1 then the published range for this example is $25 to $35 and as the prize value approaches the $35 limit the probability of it "going off" increases, just as with the normal "Cashcade".

Referring to FIG. 3 another possibility is to merely give away prizes at randomly selected times. These prizes can be fixed or random amounts. The controller would be programmed (step 30) to select a winner n times in a user defined period (step 31). Once the controller decides that it is time for a prize to be awarded (step 32), the mth game to be played from that instant becomes the winner (step 34), where m is a random number chosen between user selected limits. If a programmable sound source is fitted then the "Jackpot Imminent" sound starts at this time.

The prize amount may be chosen randomly from a user defined table of values (step 33). These could be $50, $100, etc up to a suitable maximum.

When the winning machine has been selected, the prize and winning machine are displayed (step 35) and the winning machine locked up (step 36) until the controller receives an indication that the prize is paid and the winning machine unlocked (step 37). The controller then tests to see if the nth period has elapsed (step 38) and then returns control to step 31 or step 32.

A variation of this algorithm is to have the animated display showing the prize values as they are randomly selected. It cycles through all the possible prize values, showing each one for a suitable period. When the jackpot is won, the display freezes showing the prize value that has just been won.

The following is a further simple numerical example to illustrate the process. A club with 275 machines is open daily from 10.00am until 11.00pm. The weekly turnover is $1,700,000 and it is decided to allocate 2 ½% of this to Jackpots. This means that $42,500 is to be given away in jackpots each week, or approximately $6000 per day.

The Slot Manager decides that a jackpot of some sort going off every six minutes on average would generate the excitement he is looking for. This equates to 130 jackpots in the 13 hour day. He could simply divide the $,6000 by 130 and give away 130 prizes of $46 but it would be preferable to have a range of prizes e.g.

1×$2,000=$2,000
5×$200=$1,000
24×$50=$1,200
100×$18=$1,800

The overhead displays now cycle through these values spending perhaps 1 minute displaying each one. This means that "$200" would be displayed for five 1 minute periods during the life of the particular jackpot cycle, Similarly "$50" would be displayed for a total of 24 minutes.

The display cycle is initially 130 minutes and the $2,000 prize is available for only one of those minutes. As prizes are won and removed from the pool, the cycle gets shorter and shorter until in the last six minute (average) period there is only one prize left to win.

The controller at a random time picks a number (m above), starts up the "Jackpot Imminent" sound and begins to count games. When the count reaches the value m the win is triggered and the prize as shown on the overhead display is awarded to the machine that generated that game.

The "random time" would be in minutes since the completion of the last jackpot. e.g. if the desired average interval between jackpots is six minutes then choosing randomly an interval of from 3 to 9 minutes, coupled with the variation in m should give the desired effect.

This jackpot includes every machine in the Club and it may be desirable to run smaller ones with fewer machines. Obviously the principle is the same but a corollary of this is that our new controller must be able to handle large numbers of machines.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A random prize awarding system associated with one or more gaming consoles each of which includes signal output means arranged to produce an output signal in response to operation of the respective console, the system including means to generate and store a pool of numbers, random selection means arranged to select a prize winning number from the pool of numbers, means responsive to the signals received from each associated console to randomly select from the pool a number corresponding to each said received signal, the signal responsive means being arranged to remove the selected number from the pool and to compare that number with the randomly selected prize winning number, recording means being arranged to record the identity of a console associated with the selected number when it equates to the randomly selected prize winning number and indicator means arranged to indicate details of the console associated with the prize winning number as a prize winning console and the prize awarded.

2. A random prize awarding system associated with one or more gaming consoles each of which includes signal output means arranged to produce an output signal in response to operation of the respective console, the system including random interval generating means to generate time intervals of random length, means responsive to the signals generated by the associated gaming consoles to count the occurrence of m games following the completion of each random time interval and to allocate a prize to the console reporting the mth game, prize generating means arranged to randomly select a prize and indication means arranged to indicate the identity of the prize winning console and the prize awarded.

3. The system of claim 2 where m is a predetermined number.

4. The system of claim 2 including random number generating means to generate a random value for m at the completion of each random time interval.

5. The system of claim 4 in which the randomly selected value of m selected at the end of each time interval is used to count a number of games after the end of the respective time interval.

6. The system of claim 4 in which the randomly selected value of m selected at the end of each time interval is used to count a number of games after the end of a time interval immediately following the interval with respect to which the value m was selected.

7. The system as claimed in claim 1, wherein the prizes awarded by the system are monetary amounts.

8. The system of claim 7 in which the values of the prizes are selected from a plurality of preselected values held in either a pool or range of prize values.

9. The system of claim 8 in which each selected value prize is selected by either incrementing or decrementing the previous prize value, within the range of values, during operation of the prize awarding system.

10. The system of claim 8 in which each selected prize value is selected by selecting either the previous or next value in the pool during operation of the prize awarding system.

11. The system as claimed in claim 2, wherein the prizes awarded by the system are monetary amounts.

12. The system of claim 11 in which the values of the prizes are selected from a plurality of preselected values held in either a pool or range of prize values.

13. The system of claim 12 in which each selected value prize is selected by incrementing or decrementing the previous prize value, within the range of values, during operation of the prize awarding system.

14. The system of claim 12 in which each selected prize value is selected by selecting either the previous or next value in the pool during operation of the prize awarding system.

* * * * *